US005311907A

United States Patent [19]

Houck

[11] Patent Number: 5,311,907

[45] Date of Patent: May 17, 1994

[54] VORTEX DIODE JET

[75] Inventor: Edward D. Houck, Idaho Falls, Id.

[73] Assignee: The United States of America as represented by the United States Department of Energy, Washington, D.C.

[21] Appl. No.: 67,914

[22] Filed: May 27, 1993

[51] Int. Cl.[5] ..... F15C 1/16

[52] U.S. Cl. ..... 137/810; 137/813; 137/565; 137/892

[58] Field of Search ..... 137/810, 813, 565, 569, 137/564.5, 888, 892

[56] References Cited

U.S. PATENT DOCUMENTS

| | | | |
|---|---|---|---|
| 3,645,094 | 2/1972 | Nuggs | 137/810 |
| 4,126,156 | 11/1978 | Barnes | 137/810 |
| 4,333,833 | 6/1982 | Longley et al. | 137/888 |
| 4,416,610 | 11/1983 | Gallagher, Jr. | 137/888 |
| 4,722,363 | 2/1988 | Allyn | 137/892 |
| 4,887,628 | 12/1989 | Bowe et al. | 137/810 |
| 4,887,640 | 12/1989 | Down | 137/564.5 |
| 4,917,151 | 4/1990 | Blanchard et al. | 137/810 |

OTHER PUBLICATIONS

Spectrum '92-Nuclear and Hazardous Waste Management, vol. 1 dtd Aug. 23-27, 1992, Boise, Id., USA.

*Primary Examiner*—A. Michael Chambers

*Attorney, Agent, or Firm*—Robert J. Fisher; Hugh W. Glenn; William R. Moser

[57] ABSTRACT

A fluid transfer system that combines a vortex diode with a jet ejector to transfer liquid from one tank to a second tank by a gas pressurization method having no moving mechanical parts in the fluid system. The vortex diode is a device that has a high resistance to flow in one direction and a low resistance to flow in the other.

6 Claims, 8 Drawing Sheets

VORTEX DIODE JET

CONTRACTUAL ORIGIN OF THE INVENTION

The United States Government has rights in this invention pursuant to Contract No. DE-AC07-84ID12435 between the United States Department of Energy and Westinghouse Electric Corporation.

FIELD OF THE INVENTION

This invention relates to a bidirectional liquid transfer system that incorporates a vortex diode and a jet ejector to transfer a fluid without having moving parts in the liquid.

BACKGROUND OF THE INVENTION

In the nuclear industry it is very desirable to have transfer systems that do not have any moving parts, i.e., pumps, valves, check valves, etc. The radiation fields and chemistry of the solutions quickly destroy any plastics, seals, and moving parts. Technologies that meet this criteria are jets, air lifts and fluidics. Fluidics is the technology dealing with the use of a flowing liquid or gas in various devices for controls, and fluid transfers.

In this industry it is also very desirable to produce unbiased samples and to transfer solution without dilution or concentration. Typically, air lifts and/or jet ejectors are used for sampling and solution transfers. A third option is fluidic pumping of the solution. Unlike gas jets, steam jets, or gas lift transfers, the fluidic transfer has the advantage that it does not concentrate or dilute the solution being transferred. Other fluidic transfer and fluidic sampling advantages are: (a) very high lift capability, (b) low sample scatter, (c) lower off-gas production with the attendant reduction in high-efficiency particulate HEPA filter consumption and environmental emissions, (d) dependability, and (e) very low maintenance.

Although, existing fluidic technology transfers fluids in one direction at approximately the same rate as air lifts and jets, the use of a vortex diode or reverse flow diverter (RFD) and jet ejector combination in bidirectional flow systems produces significantly higher transfer rates, i.e., 1.5 times faster than the base jet fluidic transfer rate and retains the fluidic system advantages.

Referring to FIG. 1, the basic prior art fluidic transfer systems use gas pressure 8 to transfer solution out of a pumping chamber 10, forcing the solution from the pumping chamber 10 into the feed tank, and the rest into a receiving tank 12 by operation of valves 14 (FIG. 1). The pumping chamber 10 is refilled with solution from the atmospheric-pressure feed tank 16 by gravity and the line to the receiving tank 12 as the air in the pumping chamber is vented to the feed tank through an orifice 18 in vent line 19.

A major improvement on the fluidic transfer system is accomplished by the installation of a vortex diode or reverse flow diverter 20 (RFD) in the outlet line of the feed tank 16 as in FIG. 2. An RFD consists of a tangential entry into a cylinder with the exit port 22 located in the center of the cylinder. RFDs are designed to have a higher resistance to flow in one direction (spiral entry) than in the opposite direction (elbow-like flow path). This means the pressure drop flowing through a RFD at the same flow rate in one direction, is much less than the pressure drop of the fluid flowing through the RFD in the opposite direction. With the RFD, most of the solution is pumped to the receiving tank 12, the rest goes to the feed tank 16. The refill resistance of a RFD is essentially equivalent to a tee of the same inlet and outlet diameter. As the RFD has a low refill resistance, the pumping chamber 10 refills almost as fast as the basic system, hence the overall pumping rate is greatly increased.

Another transfer system improvement is accomplished by the use of a jet as in FIG. 3. The solution from the pumping chamber 10 passes through a jet ejector 24, entraining the solution from the feed tank 16, then transferring the combined solution streams to the receiver tank 12. Since the air is not used to pump solution from the feed tank 16 by the air passing through the jet 24, this fluidic system essentially uses the solution to be transferred to pump itself. This combination (FIG. 3) refills very slowly but pumps much faster, therefore the overall pumping rate for the jet system is better than the RFD (FIG. 2) only. The fluidic jet transfer also has a much greater lift capability than air lifts or RFDS. other combinations of RFDs and jets have produced small increases in the overall pumping rate. The major limiting factor on the pumping rate of these jet fluidic systems is the refill rate of the pumping chamber 10. The pumping jet is essentially the entire resistance in this reverse flow path and reduction in the refill time can be accomplished by reducing the refill resistance of the pumping jet.

SUMMARY OF THE INVENTION

Generally speaking, the invention is a fluidic transfer system, having no moving parts, for transferring a liquid from a feed tank to a receiving tank comprising:

- a jet ejector having an inlet, an outlet connecting by conduit means to the receiving tank, and a plenum, wherein the plenum is connected by a plenum conduit means to the feed tank;
- a gas pressurized pumping chamber connecting by an inlet conduit means to the jet ejector inlet;
- a vortex diode having an inlet connecting by a conduit means to the jet ejector inlet and a vortex diode outlet connecting by conduit means to the plenum conduit means, wherein applying a gas pressure to a liquid in the pumping chamber causes flow through the jet ejector, creating a flow into the jet ejector plenum from the feed tank, a combined flow going to the receiving tank, and wherein removing the gas pressure from the pumping chamber permits a reverse flow by gravity through the vortex diode to refill the pumping chamber.

Other objects, advantages, and capabilities of the present invention will become more apparent as the description proceeds.

BRIEF DESCRIPTION OF THE DRAWINGS

The invention may be better understood and further advantages and uses thereof may become more readily apparent when considered in view of the following detailed description of the exemplary embodiments, taken with the accompanied drawings, in which.

DETAILED DESCRIPTION OF THE INVENTION

Figure 4:
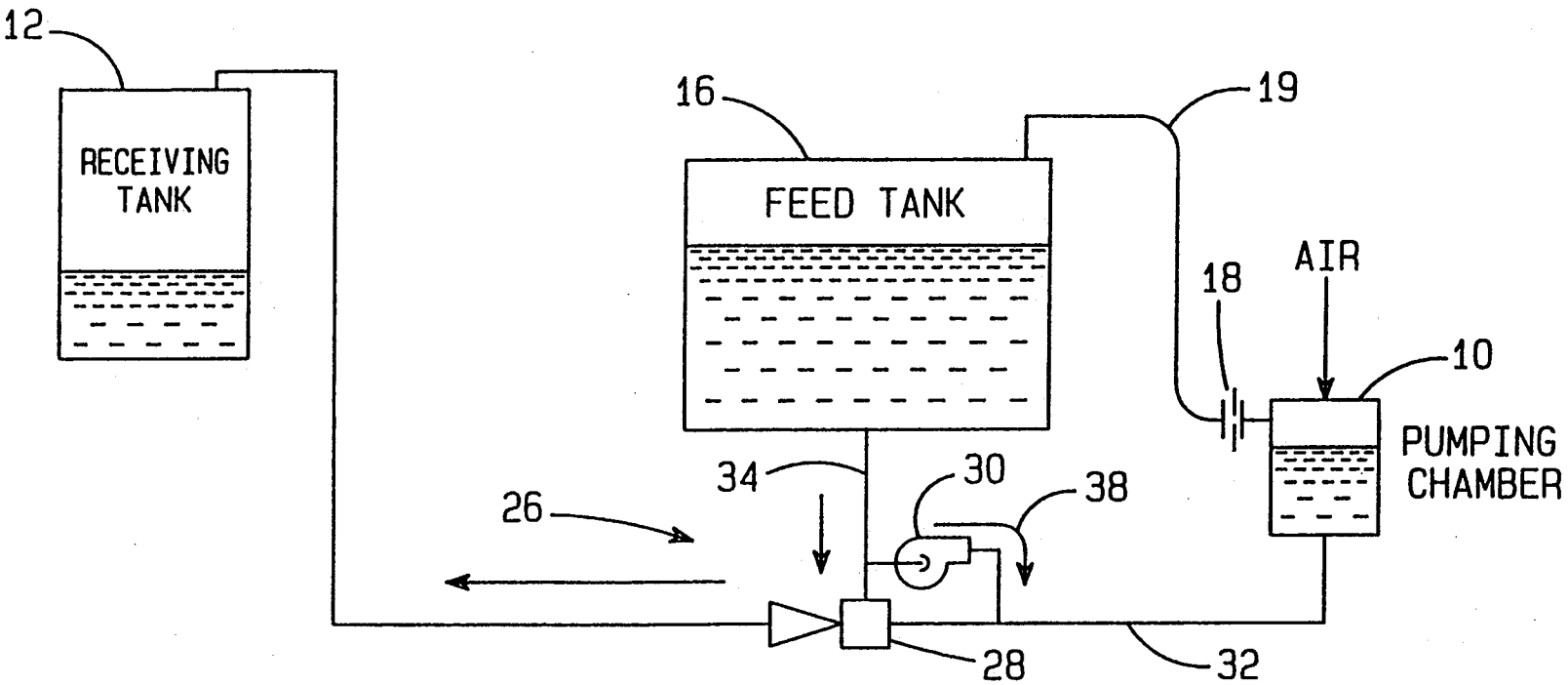
FIG. 4 is a schematic diagram of a combined reverse flow diverter (RFD) and a jet ejector of the present invention.
Figure 5A:
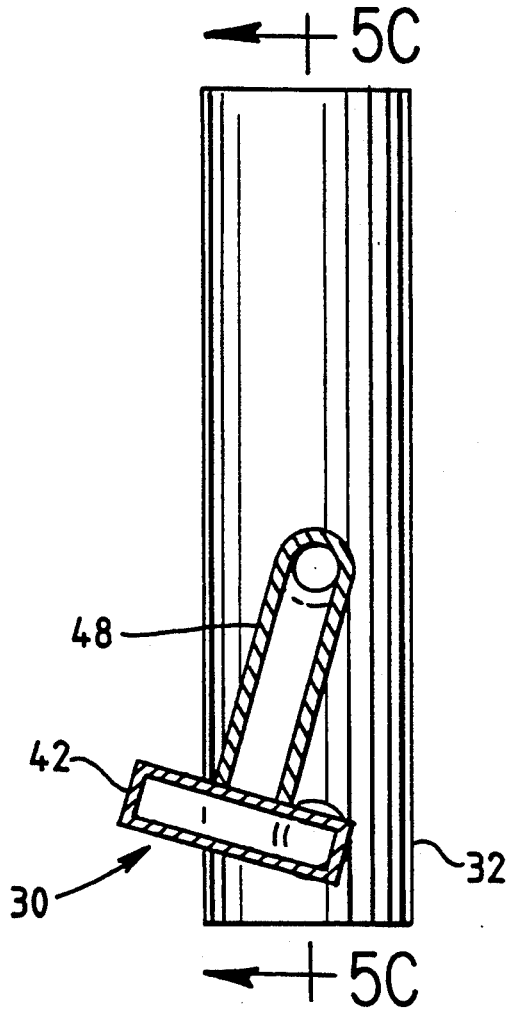
FIG. 5A is a top view of the combined RFD and jet ejector apparatus.
Figure 5B:
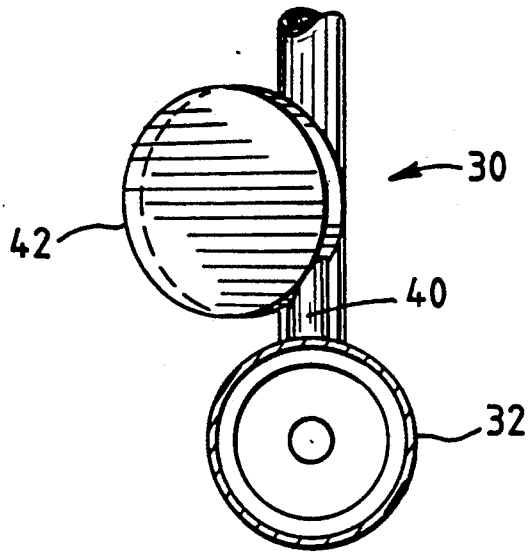
FIG. 5B is a side elevation of the combined apparatus.
Figure 5C:
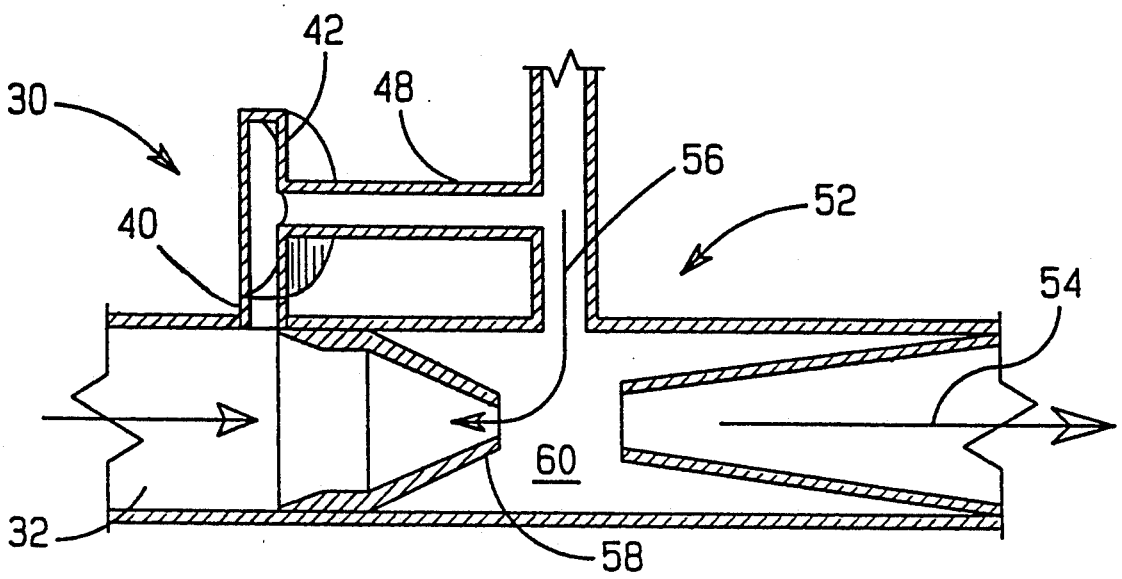
FIG. 5C is a side section view of the combined apparatus taken through line 5C of FIG. 5A.
Figure 6:
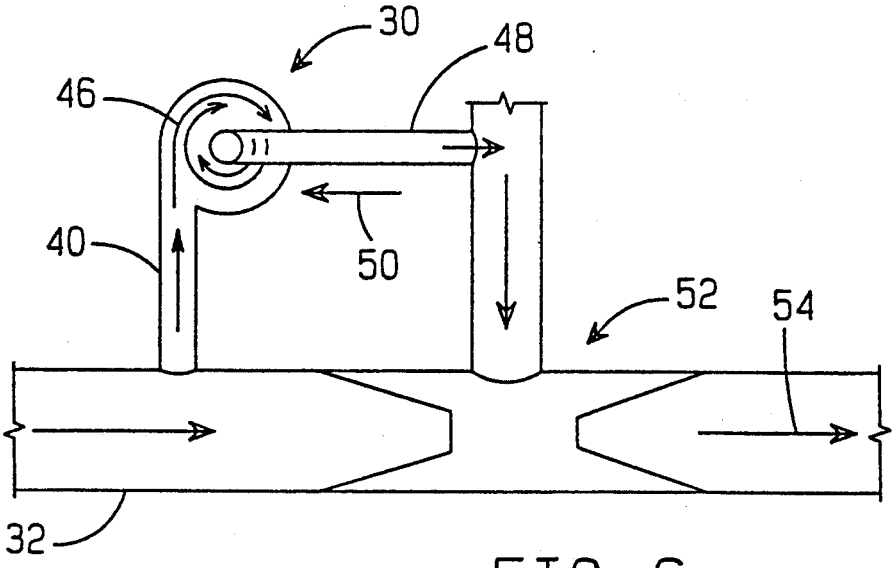
FIG. 6 is a side section schematic view of the combined apparatus.

The RFD and jet ejector apparatus 26 of FIG. 4 is a new and unique combination that produces a synergistic effect to produce a pumping device that is better than an RFD, a ejector jet, or combinations of these two that have been tried in the past, i.e., RFD in series, before and after the jet. This unique combination purposely bypasses the jet 28 with an RFD 30, connecting the jet inlet line 32 with the jet suction line 34. The combination of a jet with an RFD in this manner produces an apparatus 26 which leaks some solution through the RFD 30 (high resistance path) during pumping. However, this combination also refills very fast, primarily through the RFD as at 38, through the RFD's low resistance path. By sacrificing some of the pumping cycle flow rate, the apparatus significantly improves the overall pumping rate. This fluidic system will transfer solution much faster in transfer or sampling applications than existing technology, i.e., air lifts, jets, or any other single ejector with RFD(s) fluidic systems.

Jet ejectors use the venturi principle to entrain more solution than is fed to the motive inlet to the jet. In a fluidic application this greatly increases the pumping rate of the jet. Not only is more solution pumped than is emptied out of the pumping chamber 10 when the RFD30 is added, but the refill time is much less because only a fraction of the solution transferred has to refill the pumping chamber 10 through the very high resistance path through the jet 28.

Referring to FIGS. 5A, 5B, 5C, and 6, RFD 30 provides a high resistance to f low path by a tangential pipe 40 directing fluid into a cylindrical chamber 42 and out the centered exit 48. The tangential entry sets up flow streams that have significant friction losses between each flow spiral 46 (FIG. 6) as the flow streams spiral into the exit line and further frictional losses as the flow streams flow spirally out the exit line 48. The large frictional losses are due to: (a) the long spiral flow path 46, and (b) the viscous flow losses between flow streams flowing at different velocities and radii. In the reverse flow direction 50, the RFD friction losses are roughly equivalent to a 90° elbow. Turndown ratios of 150-1 are achievable with RFDS. That is, the pressure drop in the forward (spiral flow) direction 46 is one hundred-fifty times as much as the pressure drop in the reverse (elbow) flow direction 50 at the same volumetric flow rate.

Figure 1:
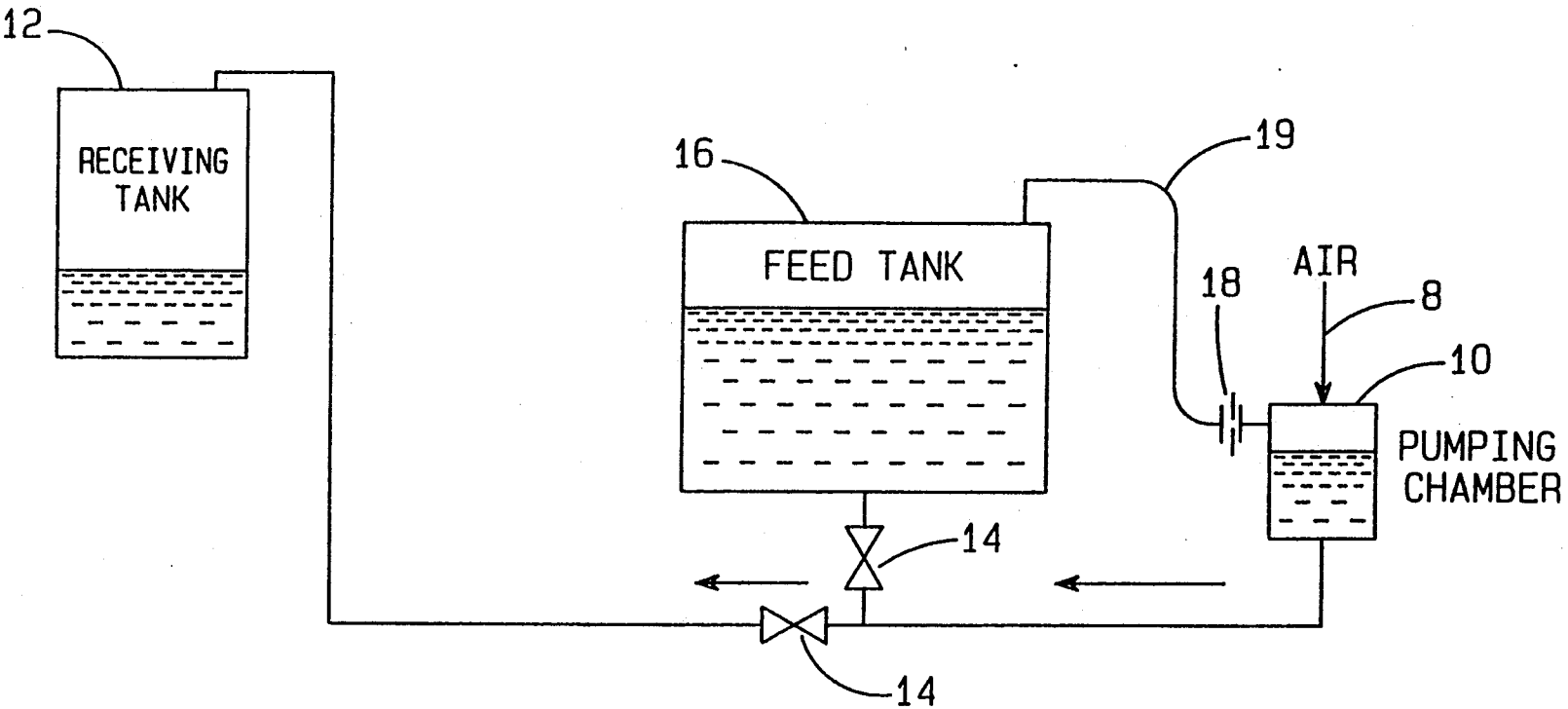
FIG. 1 (PRIOR ART)
FIG. 1 is a schematic diagram of a simple prior art pumping system.
Figure 2:
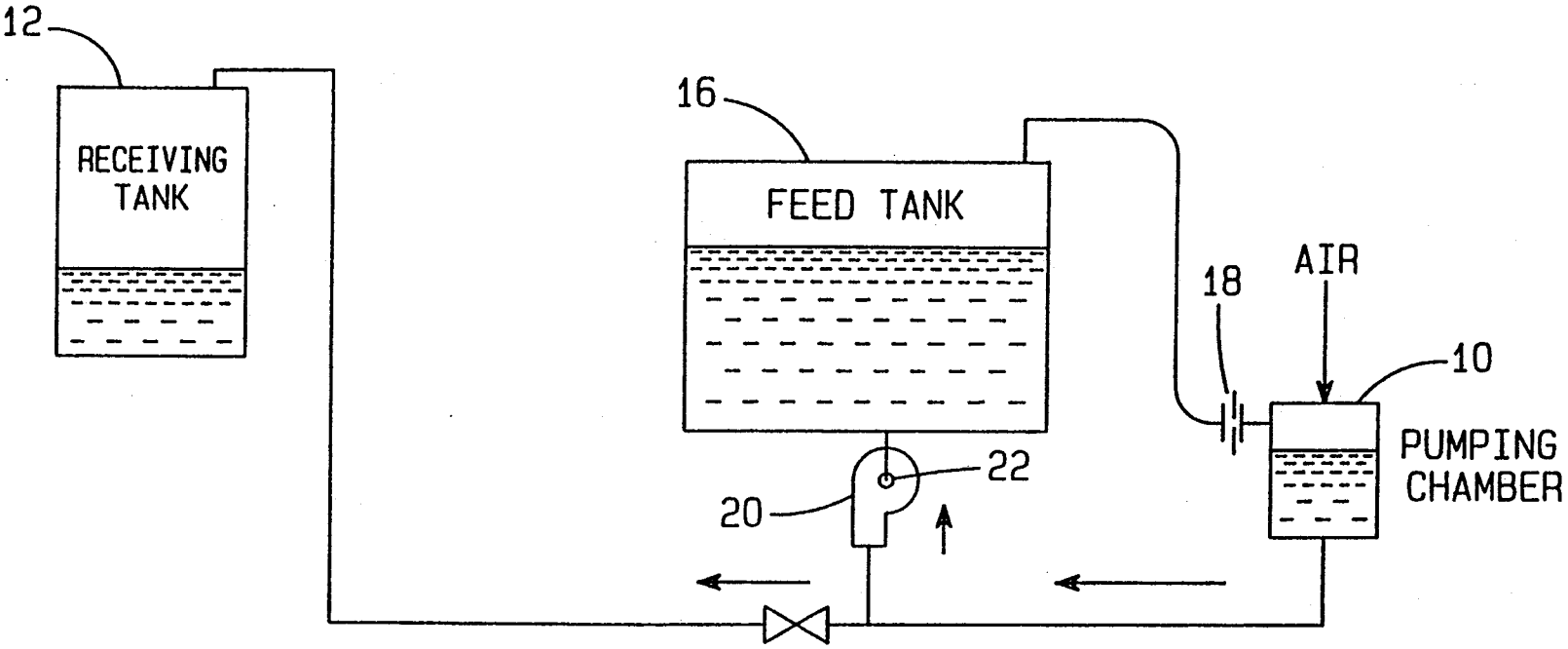
FIG. 2 (PRIOR ART)
FIG. 2 is a schematic diagram of a prior art system using a vortex diode as a reverse flow diverter.
Figure 3:
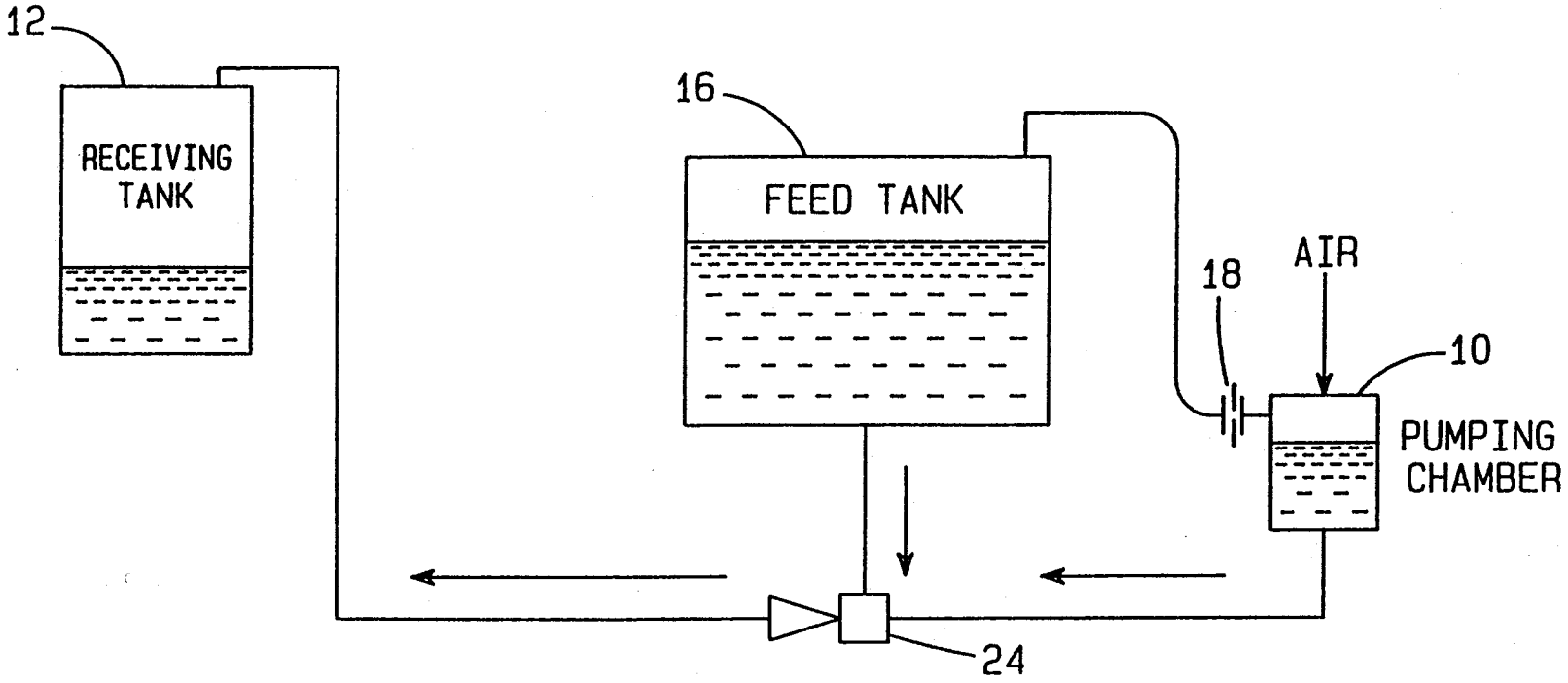
FIG. 3 (PRIOR ART)
FIG. 3 is a schematic diagram of a prior art jet ejector system.

The jet and RFD apparatus 26 combine these two technologies in a new and unique fashion to produce a pumping jet 52 that leaks some of the pumping chamber flow through the RFD, but still provides a jet that entrains a significant fraction of the jet outlet flow 54 from the feed vessel. An RFD can transfer only a fraction of the solution fed into it from a pumping chamber to the desired destination, the rest leaks into the feed tank. The RFD pumps much slower than a jet, therefore, a combined jet and RFD is a significant improvement over a pure RFD as in FIG. 3. Jets are highly resistant to flow back through them during refill (reverse flow as at 56), therefore, the actual pumping time can be a twentieth of the total pumping cycle time. The jet reverse flow can be seen to be a high resistance path due to the small inlet nozzle 58 within plenum 60 which in a ½" pipe size jet is about 1/16" diameter. Also, entering the nozzle at the convergent end significantly increases the nozzle flow coefficient to restrict flow. An RFD/jet would pump a much higher fraction of the total pumping cycle because of its fast refill rate. The lower inlet flow rate to the jet caused by bypass flow through the RFD is compensated for by the faster refill time providing more pumping cycles for a given duration. Therefore, the overall pumping rate of the RFD/jet would be faster than a jet. RFDs in front, behind, and in combination have been tried; and although these combinations are sometimes an improvement over single element systems, they do not have the key principle of the synergistic effect which is produced in a RFD/jet by the bypassing of the jet 52 with the RFD 30. Hence the simple combinations of RFDs and jets will not produce the performance of a RFD/jet. The RFD/jet, with two inlet flow paths and two refill flow paths, produces a significant increase in overall fluidic system transfer rate and thus represents a major improvement in fluidic system design.

Figure 8:
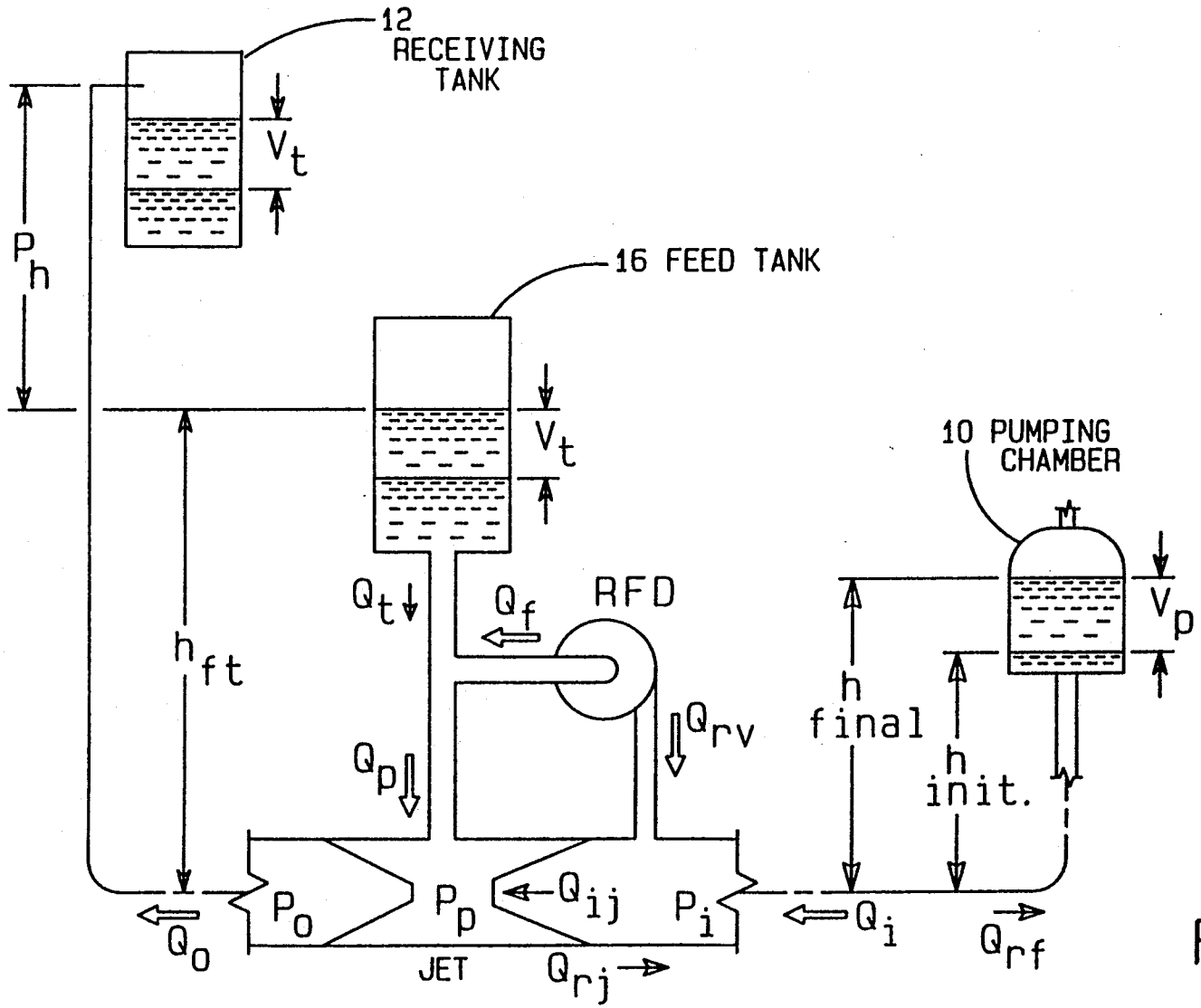
FIG. 8 is a flow diagram of the pumping apparatus.

DESIGN EQUATIONS (See FIG. 8)

JET FLOW RATES AND PRESSURE DROPS DURING PUMPING

Jet Inlet Flow Rate $$Q_{ij} = C_d A_n \sqrt{\left(\frac{2(P_i - P_p)}{\rho\left(1 - \frac{A_n^2}{A_i^2}\right)}\right)} = C_{ij}\sqrt{P_i - P_p} \quad (1)$$

where:

$C_d$=jet discharge coefficient
$C_{ij}$=jet inlet coefficient
$A_n$=area, nozzle
$A_i$=area, inlet
$P_i$=pressure, inlet
$P_p$=pressure, plenum
$\rho$=density

Jet Outlet Flow Rate $$Q_o = A_n\sqrt{\left(\frac{2(P_o - P_p)}{\rho C_p}\right)} = C_{jo}\sqrt{P_o - P_p} \quad (2)$$

$$C_{jo} = A_n\sqrt{\left(\frac{2}{\rho C_p}\right)}$$

where:

$P_o$=pressure outlet
$C_{jo}$=outlet conversion constant $C_p$=pressure recovery coefficient To allow for a difference in the entry and outlet heights of the outlet line, a term is added:

$$Q_o = C_d(\sqrt{P_o - P_p} - \sqrt{P_h}) \quad (3)$$

where: $P_h$=static pressure at outlet

Flow Rate Into The Jet From The Feed Tank $$Q_p = Q_o - Q_{ij} = Q_f + Q_t \quad (4)$$

RFD Pumping (Forward) Flow Rate In The Spiral (Pumping) Flow Path $$Q_f = \sqrt{\left(\frac{P_i - P_p}{K_f \rho}\right)} \quad (5)$$

where: $Q_f = C_{vo}\sqrt{P_i - P_p}$ $$C_{vo} = \sqrt{\frac{1}{K_F \rho}}$$

$K_f$ = *RFD* resistance coefficient

RFD Jet Pumping Flow Rate Equation

Combining equations 1 and 5 produces the Vordi Jet inlet flow equation:

$$Q_i = C_f(\sqrt{P_i - P_p}) \quad (6)$$

PUMPING CHAMBER REFILL FLOW RATES

Jet Refill Flow Rate $$Q_{rj} = \frac{2g\sqrt{h_p - h_i}}{\left(\frac{f_{p,a} + f_{p,1}}{D_p} + \frac{1}{(Cd_{a,a}^2 + Cd_{a,1}^2)A_a^2 + (K_{j,1} * f_{j,1})}\right)} \quad (7)$$

or over a small velocity range. This reduces to:

$$Q_{rj} = C_1\sqrt{h_p - h_i} \quad (8)$$

where: $C_1$=conversion constant for $Q_{rj}$

RFD Refill (Reverse) Flow Rate $$Q_{rv} = \sqrt{\left(\frac{P_p - P_i}{K_r \rho}\right)} \quad (9)$$

where: $K_r$ = *RFD* resistance coefficient

Substituting $(h_p - h_i) = \frac{(P_p - P_i)}{(\rho * g)}$ and letting $C_2 = \sqrt{\frac{g}{K_r}}$ in Equation 9:

-continued $$Q_{rv} = C_2\sqrt{h_p - h_i} \quad (10)$$

Combining Equations 8 and 10 gives:

$$Q_{rf} = Q_{rj} + Q_{rv} = (C_1 + C_2)\sqrt{h_p - h_i} = C_3\sqrt{h_p - h_i} \quad \text{where: } C_3 = C_1 + C_2 \quad (11)$$

where: $C_3 = C_1 + C_2$

TOTAL CYCLE TIME

Total pumping time is the time required to pump out the pumping chamber 10 to the desired level and the refill it to the initial pumping chamber level (see FIG. 8). Total cycle time is dependant on; outlet line pressure drop (significantly higher if there is a fluidic sampler in the line), motive pressure, the refill coefficient of the jet and RFD, and differential pressure head between the feed tank and the pumping chamber. The total cycle time equation is given:

$$T_c = \text{Total Cycle Time} = \frac{V_p}{Q_i} + \frac{V_p}{Q_{rj} + Q_{rv}} = \frac{V_p}{Q_i} + \frac{V_p}{Q_{rf}} \quad (12)$$

where: $V_p$=pumping chamber volume pumped

Average Refill Rate

Integrating the refill equation (10) over the range on the initial and final pumping chamber levels ($h_{initial}$, $h_{final}$) produces the equation for the average refill flow rate (ARFR)

$$ARFR = \frac{2C_3}{3(h_{final} - h_{initial})}\left[\sqrt{(h_{ft} - h_{initial})^3} - \sqrt{(h_{ft} - h_{final})^3}\right] \quad (13)$$

For a fixed set of refill heights this equation reduces to:

$$\textit{Average Refill Flow Rate (GPM)} = C_3 * h_{factor} \quad (14)$$

OVERALL PUMPING RATE

Overall pumping rate is simply the volume, $V_t$, pumped into the receiving tank divided by the total cycle time. Overall pumping rate is also dependant on the outlet line pressure drop (especially if there is a fluidic sampler in the line), motive pressure, refill coefficient of the jet/RFD, and differential pressure head between the feed tank and the pumping chamber. The overall pumping rate equation is:

$$Q_{or} = \text{Overall Pumping Rate} = \frac{\text{Total Volume Pumped}}{\text{Total Cycle Time}} = \frac{V_t}{T_c} \quad (15)$$

Combining the refill and pumping equations with equation 13 produced the overall pumping rate equation:

$$\text{Overall Pumping Rate } (GPM) = \frac{C_o\sqrt{P_o - P_p}}{1 + \frac{C_i\sqrt{P_i - P_p}}{C_3 * h_{factor}}} \quad (16)$$

EXPERIMENTAL TESTS

Figure 7:
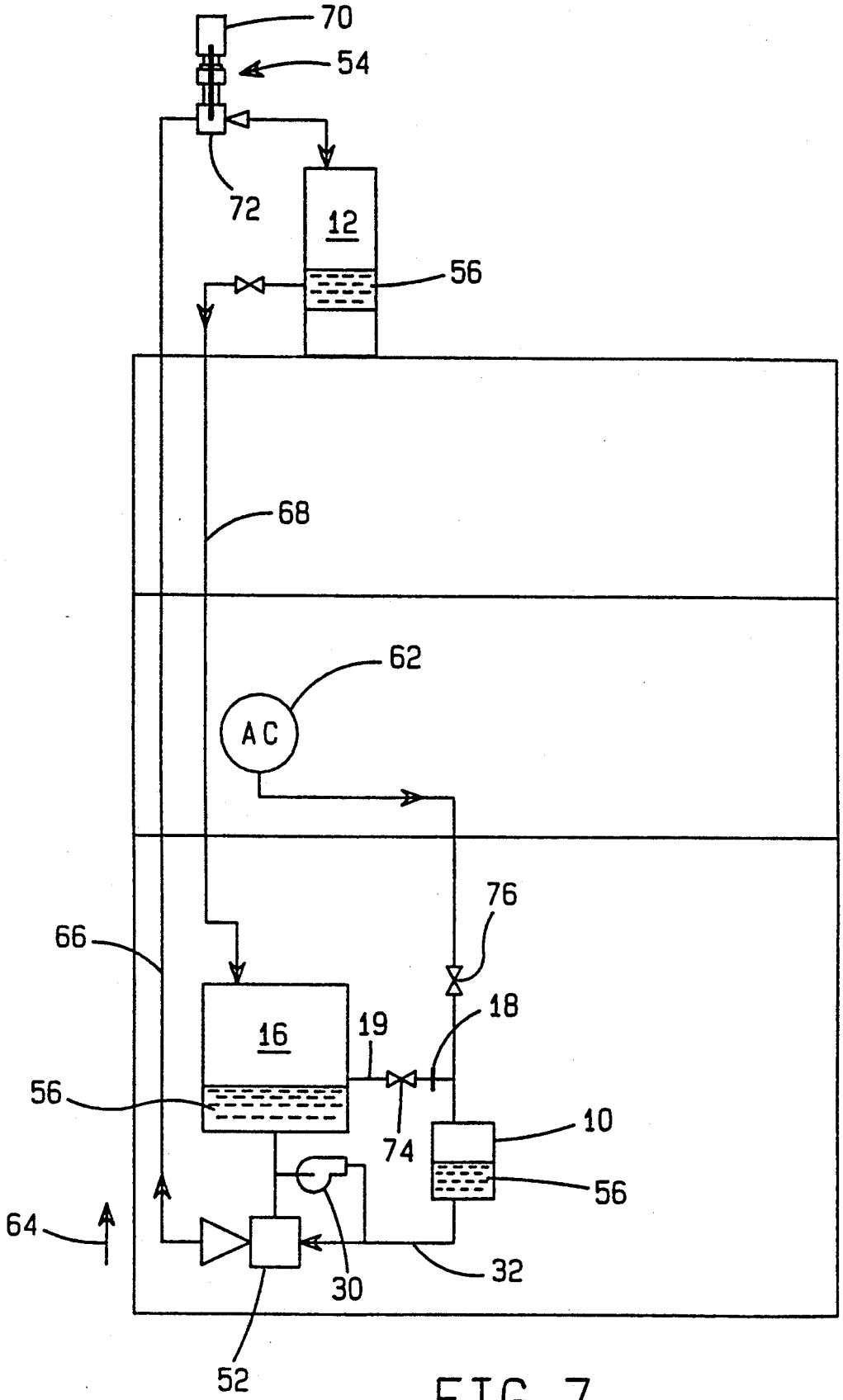
FIG. 7 is a schematic diagram of the test system and combined pumping apparatus.

The fluidic sampler test setup is shown in FIG. 7. This setup tested two main versions of jets 52: a ½" Fox and a ½" Penberthy jet in the test setup in combination with various sizes, i.e., ⅛", ¼", ⅜", and ½" pipe diameter RFDS. These tests were performed with and without the fluidic sampler 54 in the system. Water 56 was used as the transfer medium. Air from an air compressor 62 was used to drive the water from the pumping chamber 10 through the jet 52. The jet entrained some liquid from the feed tank 16, and the combined flows 64 emptied into the receiving tank. When the jet 52 is overwhelmed by the outlet pipe 66 pressure, typically by the large outlet head, solution flow is into the feed tank with none or part of the flow going out the jet outlet pipe 66. Water level in the feed tank was varied to provide a range of lifts.

The vent line orifice 18 size was varied to provide a range of pumping and refill times for the Fox baseline jet i.e., a ½" Fox jet operating without an RFD. Air pressure to the pumping chamber 10 was also varied from about 20 to 125 psi to provide a range of pumping rates so that the inlet 32 and outlet 66 flow coefficients for the jets 52 could be determined.

EXPERIMENTAL EQUIPMENT

FIG. 7 shows the details of the fluidic sampler mock-up. The following were all of stainless steel: drip pans (not shown), pumping chamber 10, pumping jet 52 (RFD/ejector jet or baseline), tubing fittings, flow and pressure meters, fluidic jet sampler 54, tubing between the pumping chamber 10, pumping jet 52, feed tank 16, and the start of the vertical run of the pumping jet outlet 66 line. The pumping chamber 10 was an 8" (high pressure) schedule 80 stainless steel pipe, 3'9" tall, with an internal volume of 7.91 gallons. The feed tank 16 was a 9'4.5" tall fiberglass tank at atmospheric pressure with a conical bottom. The receiving tank 12 was a 50 gallon polypropylene tank with a lid. Piping from the compressor 62 to the pumping chamber line, receiving tank return line 68, and pumping chamber vent line were polyethylene. The fluidic jet samplers 54 used in some test runs consist of a sample bottle 70 connected to a second jet injector 72 which created a significant pressure drop in the system. The pumping chamber 10 is used since it can be pressurized above 100 psi, whereas the feed tank 16 cannot be pressurized.

EXPERIMENTAL PROCEDURE

The fluidic transfer mock-up was operated with a consistent feed tank 16 level and orifice 18 size for each run. Pumping pressure was varied for the runs. The Fox baseline jet was operated with a variety of orifice sizes including use of a ½" valve 74. The other configurations were operated with the ½" valve 74 acting as the vent line orifice. The pumping chamber can be partially or completely emptied of solution during a pumping cycle. The Fox baseline jet runs were operated over a range of partially emptying the pumping chamber 10 and fully emptying the pumping chamber. Two methods were employed for emptying the pumping chamber: firstly, turning off the inlet air valve 76 so the pumping chamber 10 is just emptied without leakage of air through the pumping jet 52, and, secondly, pumping until the air just exits the pumping chamber 10 and jet inlet line 32 and then turning off the inlet air ("blowout" operation). The latter method was used for all the runs for the other configurations, as the most accurate and repeatable data was achieved by using the "blowout" method.

The pumping jet inlet 32, plenum 60 (FIG. 5C), and outlet 66 pressures and flow rates were measured and recorded. The total solution transferred during each pumping cycle was collected and measured. Time required to complete each pumping and refill cycle was recorded, as well as some of the transient times to steady state conditions for the inlet and outlet flows. The fluidic sampler test setup was operated by opening the pressurized air inlet valve 76 to the pumping chamber 10. When the desired low solution level in the pumping chamber was reached, the ½" vent valve 74 was opened, if previously closed; if not, then the vent line orifice 18 was already venting the pumping air and the pressurized air inlet valve 76 closed. The pumping chamber 10 was then refilled with a solution from the feed tank 16 and a small amount of the returning solution from the jet outlet (sampler inlet) line 66, by gravity. This completes a pumping cycle, additional cycles were performed.

When the sampler 54 was installed in the mock-up the sample bottle's final level was recorded, as well as when the sample bottle 70 and sample needle were installed on the sampler to take a sample. The point in the pumping cycle (start, middle, end) at which the sample needle and bottle 70 were placed on the fluidic sampler 54 was varied. Typically, the sample needle and bottle 70 were put in place prior to opening the pressurized air inlet valve 76.

Overall Flow Rate

The following are overall flow rate data for two typical cases: feet tank water height $h_{ft}$=4.083', pump chamber water initial height $h_{pc,final}$=0.4167', pump chamber water final height $h_{pc,final}$=3.75'; for Case 1: jet inlet pressure $P_i$=60.1–62.5 psig, jet plenum pressure $P_p$=2.0–2.6 psig, jet outlet pressure $P_o$=19–21 psig,; and Case 2: $P_i$=80–84.4 psig, $P_p$=2.0–2.6 psig, $P_o$=2-0–22 psig, without the sample. The overall flow rates for cases 1 and 2 are calculated from actual data using equation 15 and shown in Tables 1 and 2, respectively. The first data set is baseline data without the RFD, i.e., only the pumping jet. As can be seen at the lower inlet pressure (Case 1), the flow improvement for the Fox jet is 0.19/0.11 or 1.7 using the ½" RFD, and, for Case 2 using the Penberthy jet, the improvement is 0.25/0.063 or about 4.0.

TABLE 1

Overall Pumping Rates for a Typical Case ($P_i$ = 62 psi)
Case 1

| RFD SIZE | FOX JET FLOW RATE (GPM) | PENBERTHY JET FLOW RATE (GPM) |
|---|---|---|
| None | 0.11 | 0.00 |
| ⅛" | 0.19 | N.A. |
| ¼" | 0.18 | 0.14 |
| ⅜" | N.A. | 0.22 |
| ½" | N.A. | 0.18 |

TABLE 2

Overall Pumping Rages for a Typical Case ($P_i$ = 84 psi)
Case 2

| RFD SIZE | FOX JET FLOW RATE (GPM) | PENBERTHY JET FLOW RATE (GPM) |
|---|---|---|
| None | 0.18 | 0.063 |
| ⅛" | 0.30 | N.A. |
| ¼" | 0.29 | 0.25 |
| ⅜" | N.A. | N.A. |
| ½" | N.A. | N.A. |

While a preferred embodiment of the invention has been disclosed, various modes of carrying out the principles disclosed herein are contemplated as being within the scope of the following claims. Therefore, it is understood that the scope of the invention is not to be limited except as otherwise set forth in the claims.

What is claimed is:

1. A fluidic transfer system, having no moving parts, for transferring a liquid from a feed tank to a receiving tank comprising:

a. a jet ejector having an inlet, an outlet connecting by conduit means to the receiving tank, and a plenum, wherein the plenum is connected by a plenum conduit means to the feed tank;

b. a gas pressurized pumping chamber connecting by an inlet conduit means to the jet ejector inlet;

c. a vortex diode having an inlet connecting by a conduit means to the jet ejector inlet and a vortex diode outlet connecting by conduit means to the plenum conduit means, wherein applying a gas pressure to a liquid in the pumping chamber causes flow through the jet ejector, creating a flow into the jet ejector plenum from the feed tank, a combined flow going to the receiving tank, and wherein removing the gas pressure from the pumping chamber permits a reverse flow by gravity through the vortex diode to refill the pumping chamber.

2. The fluidic transfer system as recited in claim 1 wherein the ejector jet is a ½" pipe size jet and the vortex diode is in a range of ⅛" to ½" pipe size.

3. The fluidic transfer system as recited in claim 1 wherein the gas pressure is in the range of 60 to 120 psi.

4. The fluidic transfer system as recited in claim 1 wherein the jet ejector is ½" pipe size, the vortex diode is ⅛" pipe size, and the gas pressure is 80 and 125 psi.

5. A fluidic transfer system, having no moving parts, for transferring a liquid from a feed take to a receiving tank comprising:

a. a ½" pipe size jet ejector having an inlet, an outlet connecting by conduit means to the receiving tank, and a plenum, wherein the plenum is connected by a plenum conduit means to the feed tank;

b. a gas pressurized pumping chamber connecting by an inlet conduit means to the jet ejector inlet;

c. a ⅛" pipe size vortex diode having an inlet connecting by a conduit means to the jet ejector inlet and a vortex diode outlet connecting by conduit means to the plenum conduit means, wherein applying a gas pressure of about 80 to 125 psi to a liquid in the pumping chamber causes flow through the jet ejector, creating a flow into the jet ejector plenum from the feed tank, a combined flow going to the receiving tank, and wherein removing the gas pressure from the pumping chamber permits a reverse flow by gravity through the vortex diode to refill the pumping chamber.

6. A fluidic transfer system, having no moving parts, for transferring a liquid from a feed take to a receiving tank comprising:

a. a ½" pipe size jet ejector having an inlet, an outlet connecting by conduit means to the receiving tank, and a plenum, wherein the plenum is connected by a plenum conduit means to the feed tank;

b. a gas pressurized pumping chamber connecting by an inlet conduit means to the jet ejector inlet c. a ¼" pipe size vortex diode having an inlet connecting by a conduit means to the jet ejector inlet and a vortex diode outlet connecting by conduit means to the plenum conduit means, wherein applying a gas pressure of about 80 to 125 psi to a liquid in the pumping chamber causes flow through the jet ejector, creating a flow into the jet ejector plenum from the feed tank, a combined flow going to the receiving tank, and wherein removing the gas pressure from the pumping chamber permits a reverse flow by gravity through the vortex diode to refill the pumping chamber.

* * * * *